United States Patent [19]

Haytayan

[11] 4,196,833

[45] Apr. 8, 1980

[54] PNEUMATIC TACKING TOOL

[76] Inventor: Harry M. Haytayan, Sunnyside La., Lincoln, Mass. 01773

[21] Appl. No.: 950,008

[22] Filed: Oct. 10, 1978

[51] Int. Cl.[2] ..... B25C 1/04

[52] U.S. Cl. ..... 227/8; 173/15; 227/130; 227/148

[58] Field of Search ..... 227/8, 130, 148; 173/13, 15; 91/461

[56] References Cited

U.S. PATENT DOCUMENTS 3,360,176 12/1967 Gehl et al. ..... 227/148

3,923,226 12/1975 Maier ..... 227/8

4,040,554 8/1977 Haytayan ..... 227/8

*Primary Examiner*—John McQuade

*Attorney, Agent, or Firm*—Schiller & Pandiscio

[57] ABSTRACT

An improved type of pneumatic tacking tool is disclosed for use in fastening carpet tacking strips and the like to wooden or concrete floors. The tool comprises a modification of the fastener driving tool described in my U.S. Pat. No. 4,040,554 and my U.S. Pat. No. 4,122,904, and is particularly well suited to setting fasteners close to walls without the tool contacting the walls.

16 Claims, 2 Drawing Figures

PNEUMATIC TACKING TOOL

BACKGROUND OF THE INVENTION

The present invention relates to pneumatic tools in general, and more particularly to an improvement in pneumatic fastener drivers of the type shown in U.S. Pat. No. 4,040,554 and my U.S. Pat. No. 4,122,904.

Wall to wall carpeting is normally held in place by first securing carpet tacking strips to the perimeter of the bare floor which is to be carpeted and then in turn fastening the carpet to the tacking strips. The tacking strips are generally made of wood (typically 1" wide and ¼" thick) and have attached thereto a plurality of small tacks which extend in an upwards direction for engaging and gripping the bottom of an overlaid carpet. In order to assure firm positioning of the carpet, it is generally necessary to fasten down the tacking strips very close to the perimeter of the area which the carpet is to cover (and hence very close to the walls of the room in the case of wall to wall carpeting) and fill the area between the strips with carpet padding. Once this is done the carpeting is laid down.

The tacking strips may be fastened to the floor with a variety of different tacking tools. For example, several such tacking tools are illustrated and described in U.S. Pat. No. 3,711,008 and the reference cited therein. In general the tools may be classified into three main types: manual, explosive and pneumatic. The existing tools presently on the market have generally been found to be unsatisfactory due to one or more of the following reasons: excessive noise, excessive recoil, high cost, low power, operator fatigue, smoke production, poor reliability, excessive size, poor safety features, slow speed of operation or wall damage during use.

OBJECTS OF THE PRESENT INVENTION

As a result, one of the objects of the present invention is to provide a safe, reliable tool which is light in weight, low in cost, small in size and quiet in operation.

Another object is to produce a pneumatic driver which is an improvement over pneumatic tools of the type shown in U.S. Pat. Nos. 4,040,,554 and 3,711,008 and the references cited therein.

Still another object is to produce a pneumatic tool which is adapted to be small in size, operate at relatively low pressures, e.g. 80–150 psi, and still generate the force required to drive fasteners into concrete or other hard surfaces.

Yet another object is to produce a tacking tool which is adapted to set fasteners very close to walls without having the tool actually touch the walls, in order to minimize any possibility of damage to the walls.

SUMMARY OF THE PRESENT INVENTION

These and other objects of the present invention are addressed by providing a tacking tool which comprises an improved version of the tool shown in U.S. Pat. No. 4,040,554. The present tool is particularly well adapted for use in fastening carpet tacking strips to concrete and wood floors and comprises a housing, a cylinder disposed in the housing, a piston slidably mounted in the cylinder, a hammer connected to the piston, means for causing the piston to reciprocate so as to drive the hammer from a first retracted position to a second extended position, a magazine for holding a supply of fasteners and a nozzle for receiving the fasteners from the magazine and positioning them for engagement with the hammer in order that the hammer might drive the fasteners from the nozzle into a workpiece. The tool also is provided with a handle and trigger at the top end of the housing and has its nozzle specifically adapted to allow using the tool near walls and other upright structures without the tool contacting the structures.

DESCRIPTION OF THE DRAWINGS

Still other objects and features of the present invention will be rendered obvious by the following detailed description of the preferred embodiment, which is to be considered together with the accompanying drawings wherein like numbers refer to like parts and further wherein.

DESCRIPTION OF THE PREFERRED EMBODIMENT

Figure 1:
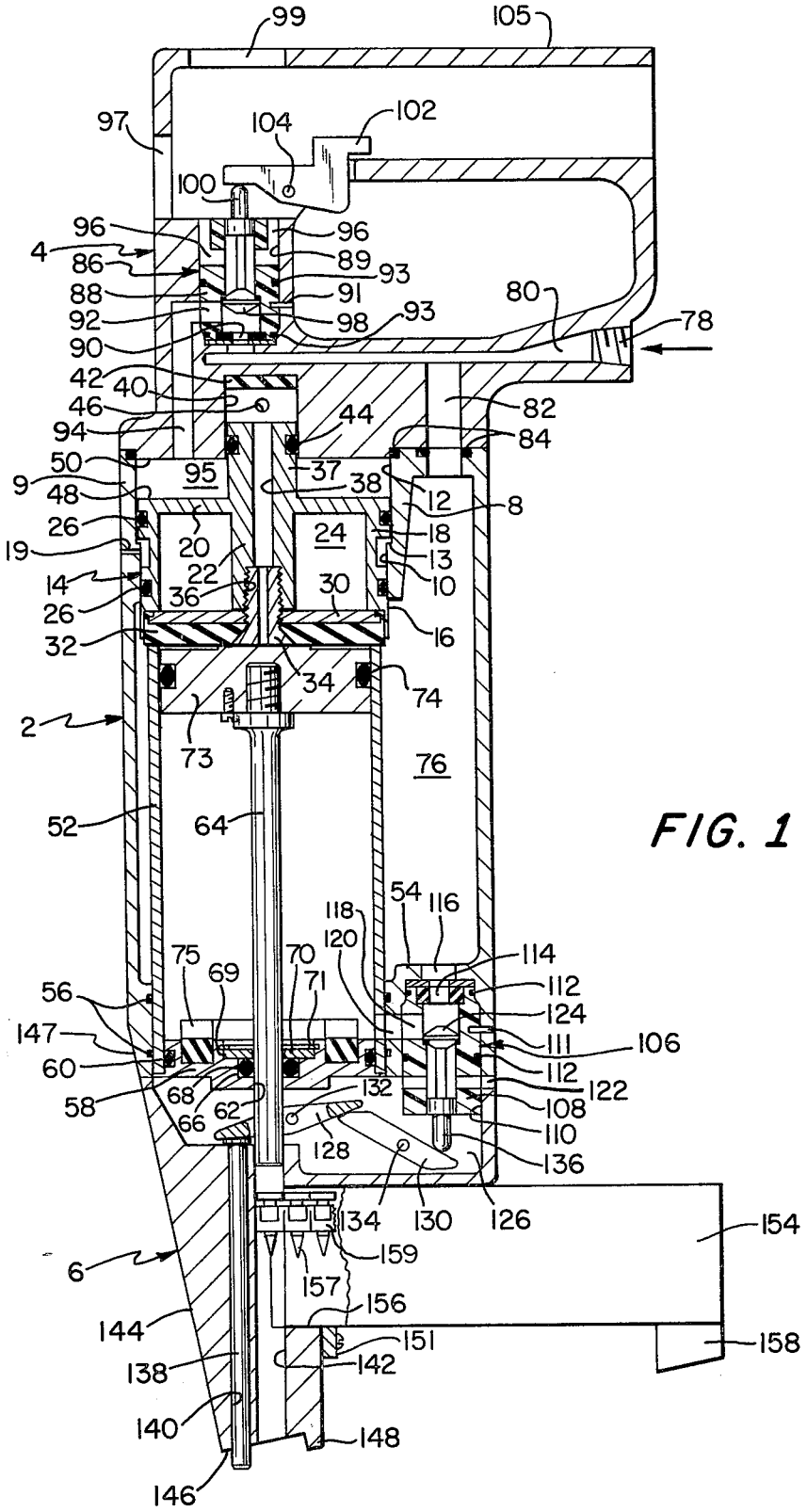
FIG. 1 is a sectional view in elevation of the preferred form of the present invention, showing the device with its hammer in a retracted position.

Referring first to FIG. 1, the preferred form of the present invention generally comprises a hollow housing 2, a top handle 4 and a nozzle 6. Handle 4 and nozzle 6 are detachably secured to the upper and lower ends of the housing respectively by means of screws (not shown).

The upper end of housing 2 is provided with an end wall 8 which, in combination with a portion of the housing side wall 9, serves as a poppet valve housing. To this end housing 2 and end wall 8 together define a cylindrical bore 10 and a cylindrical counterbore 12. A shoulder 13 is formed where the bore and counterbore meet. Slidably disposed within bore 10 is a hollow poppet valve generally identified by the numeral 14. Valve 14 generally comprises a cylindrical outer wall 16 sized to make a close sliding fit with bore 10, a peripheral flange 18 sized to make a close sliding fit with counterbore 12 and an upper end wall 20. A central boss 22 is formed integral with end wall 20 and is spaced from wall 16 and flange 18 so as to form an internal chamber 24. Seals 26 are set within grooves in the outer surfaces of wall 16 and flange 18 and serve to prevent leakage of fluid between wall 16 and bore 10 and between flange 18 and counterbore 12, while still allowing the poppet valve to move freely within its housing. One or more small passageways 19 are provided immediately above shoulder 13 to serve as bleeds to prevent a pressure buildup between the lower side of flange 18 and the shoulder 13. The passageways are positioned and sized such that they are always located below the seal 26 set in flange 18, regardless of the position of poppet valve 14. The bottom of the poppet valve is closed off by a rigid circular plate 30 which has a resilient pad 32 bonded thereto. Plate 30 and pad 32 are secured to the poppet valve by means of a hollow screw 34, which is received by a threaded axial bore 36 formed in boss 22.

The poppet valve also comprises an axial extension 37 which is formed integral with wall 20. Extension 37 is provided with a central bore 38 which communicates with the region below pad 32 by means of the hollow interior of screw 34. A circular bore 40 is formed in handle member 4 and serves to receive the axial extension 37. Bore 40 and extension 37 are respectively sized to form a close sliding fit, and a resilient seat 42 is secured at the upper end of bore 40 for engagement with the top end of extension 37 when the poppet valve is raised upwards. The outer wall of extension 37 carries a seal 44 therein for preventing any leakage of fluid between extension 37 and bore 40. Also provided in handle 4 is at least one port 46 which serves to transmit air from the interior of bore 40 to the outside atmosphere. It will be seen that port 46, bore 40, bore 38 and the interior of screw 34 combine to form a vent for fluid discharge from the underside of the poppet valve to the atmosphere. The axial dimensions of recess 40, extension 37, bore 10, counterbore 12, flange 18 and wall 16 are made such that when the poppet valve moves upward so that extension 37 seats firmly on resilient seat 42, a small gap will exist between the top surface 48 of poppet valve end wall 20 and bottom surface 50 of handle member 4. In addition, the surface area of surface 48 is sized to exceed the bottom surface area of pad 32.

Also set within housing 2 is a hollow cylinder 52. Cylinder 52 is secured at its bottom end in an opening in a bottom end wall 54 and is positioned such that pad 32 of poppet valve 14 will form a tight seal with the upper end of the cylinder when the valve is in its down position. Two sealing rings 56 serve to prevent any flow of fluid between the outer surface of the cylinder and end wall 54. The bottom end of the cylinder is closed off by a round plug 58. Plug 58 preferably carries a resilient O-ring 60 in an exterior groove for preventing passage of fluids between the plug and the interior wall of the cylinder. A central bore 62 exists in plug 58 and serves to slidably accommodate a hammer 64. A first counterbore 66 is formed in plug 58 for accommodating a resilient seal 68 which surrounds and engages hammer 64 with just enough force to prevent leakage of fluid therebetween, while allowing the hammer to move axially in bore 62. A second counterbore 69 is formed in plug 58 just above counterbore 66 and receives a thrust washer 70 which serves to retain seal 68 in place and also guide hammer 64 as it reciprocates. A snap ring 71 is disposed in a groove in plug 58 so as to hold washer 70 in place.

The upper end of hammer 64 is attached to a circular piston 73 which has flat upper and lower surfaces and is sized to make a close sliding fit with the interior surface of cylinder 52. Piston 73 is provided with a peripheral groove which receives a sealing ring 74 which prevents leakage of fluid between piston 70 and cylinder 52 while allowing the piston to move within the cylinder. A cushion member 75 is attached to the upper surface of plug 58 and serves to cushion the impact of piston 73 upon plug 58. Cylinder 52 is spaced from the interior of housing 2 so as to form a chamber 76 which serves as an air reservoir. Additionally the outer diameter of the poppet valve is sized slightly greater than the outer diameter of cylinder 52 so that a small portion of the valve projects radially of the cylinder.

An inlet port 78 is formed in handle 4 and is threaded for attachment to a flexible hoseline leading to a regulated source of fluid pressure, e.g. an air compressor. A passageway 80 leads into the tool from port 78 and intersects a passageway 82 which leads into chamber 76. Seals 84 serve to prevent leakage of fluid between handle member 4 and top end wall 8. In this manner chamber 76 may be pressurized via port 78.

Passageway 80 also leads to a control valve 86 set into top handle 4. Valve 86 and also valve 106 hereinafter discussed are substantially the same as the ones shown in my U.S. Pat. No. 4,122,904 and, therefore, they are described hereinafter only to the extent required to understand their function and mode of operation and their relationship to the tool of which they form a part. Valve 86 comprises a valve casing 88 set into a bore 89 extending at substantially a right angle to passageway 80. Valve casing 88 is locked in place by a dowel pin 91. Two resilient seals 93 are secured in grooves in the exterior of casing 88 and serves to form an airtight seal with the surrounding portion of the handle. Casing 88 has an end port 90 which communicates with passageway 80 and admits pressurized air from that passageway into the interior of the valve casing, a side port 92 which connects the interior of the valve casing with a passageway 94, which in turn leads to an airtight chamber 95 located immediately above poppet valve 14 and below handle 4, and one or more top ports 96 which connect the interior of the valve casing with the outside atmosphere. Chamber 95 is part of the interior of the poppet valve housing formed by end wall 8, a portion of side wall 9 and the lower end surface 50 of handle 4. A reciprocating valve head 98 is disposed within the interior of valve casing 88 and is adapted to move between two limit positions so as to alternately close off port 90 or port(s) 96, though it can never close off the side port 92 which leads to chamber 95. Hence when valve head 98 closes off port(s) 96 pressurized air from passageway 80 can flow into the interior of the valve 86 via port 90 and out port 92 into passageway 94, thereby pressurizing chamber 95 and acting on the top of poppet valve 14. However, when port 90 is closed off by valve head 98, the pressurized air within chamber 95 will be vented to the atmosphere via passageway 94, port 92, the interior of valve 86, port(s) 96, and a pair of ports 97 and 99 formed in handle 4. Movement of the valve head 98 is controlled by means of a valve rod 100 and a trigger assembly 102. The latter is pivotally mounted to handle 4 by a pivot pin 104. Rod 100 is fastened to valve head 98 and is aligned with trigger 102. Normally the presence of pressurized air in passageway 80 will force valve head 98 away from port 90 so that port 90 is open and port 96 is closed. This allows chamber 95 to be pressurized. However, when trigger 102 is pulled so that it rotates counterclockwise about its pivot pin 104, rod 100 will be forced downwards by the trigger, whereby valve head 98 will be urged towards port 90 so that port 90 will be closed off and port(s) 96 opened. This allows chamber 95 to be vented. In this manner chamber 95 may be selectively pressurized or vented.

A rod-operated control valve 106 is set into the bottom end wall 54 below chamber 76. As noted previously, valve 106 is substantially the same as valve 86. It comprises a valve casing 108 set into a bore 110 in end wall 54 and locked into place by a dowel pin 111. A pair of resilient seals 112 are secured in the exterior of casing 108 and serve to form an airtight seal with the surrounding surface of end wall 54. Housing 108 has an end port 114 which serves to admit pressurized air into the interior of the valve casing from a passageway 116 in end wall 54. Passageway 116 communicates with chamber 76. Housing 108 also has a side port 118 which connects the interior of the valve with a passageway 120 leading to the interior of cylinder 52 at its lower end, and an end port 122 which vents the interior of the valve to the outside atmosphere through an opening in the upper end of nozzle 6. A reciprocating valve head member 124 is disposed within the interior of the valve and is adapted to move between two limit positions so as to alternately close off port 114 or port 122, though it can never close off the side port 118 which leads to the interior of the cylinder. Hence when valve head 124 closes off port 122 pressurized air from chamber 76 can flow into the interior of the cylinder and acting on the underside of piston 73. However, when port 114 is closed off by valve head 124 the pressurized air within the cylinder will be vented via passageway 120, port 118, the interior of the valve casing and port 122.

Movement of valve head 124 is controlled by a mechanical linkage carried by nozzle 6. The upper end of the nozzle has a cavity 126 in which is disposed pivot arms 128 and 130 which pivot respectively on pivot pins 132 and 134 set into nozzle 6. Pivot arm 130 contacts a rod 136 which is attached to valve head 124. Pivot arm 128 contacts a rod 138 which is slidably received by a bore 140 set in nozzle 6. When chamber 76 is pressurized the force of the air will normally push the valve head 124 away from port 114 and rod 136, acting through arms 128 and 130, will cause rod 138 to extend a short distance, e.g., ¼–½", below the bottom of nozzle 6 and substantially beyond the end of hammer 64 when the latter is in retracted position. However, when rod 138 is brought against a rigid surface with sufficient force, the rod will retract sufficiently to become flush with the bottom end surface of nozzle 6, thereby causing pivot arms 128 and 130 and rod 136 to move valve head 124 upward sufficiently to close off port 114. In this way the interior of the cylinder 52 may alternately be pressurized or vented by manipulating rod 138.

Figure 2:
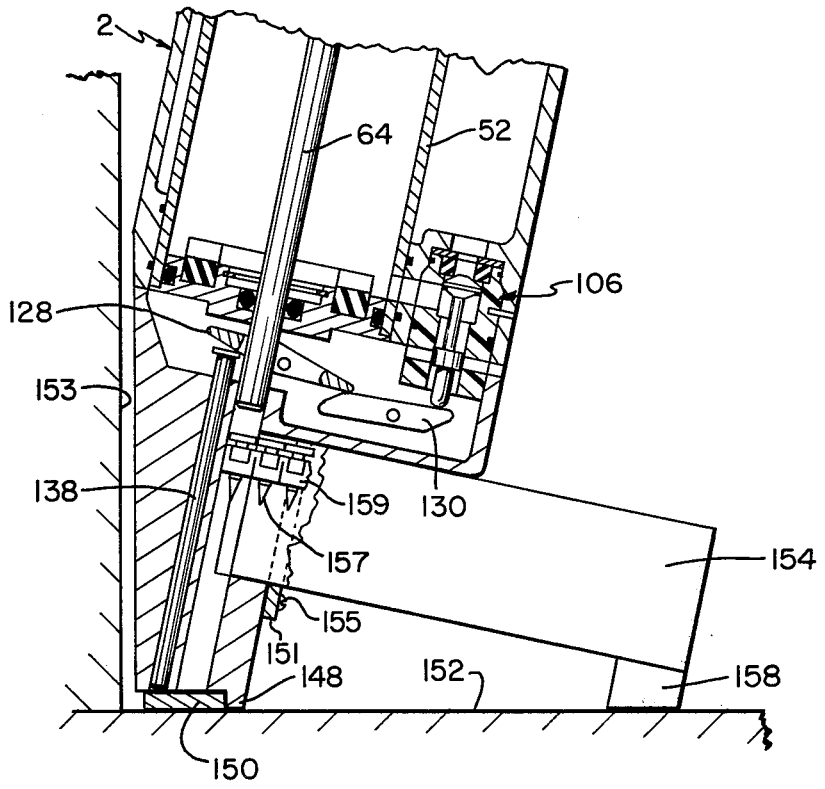
FIG. 2 is a partial sectional view in elevation showing the nozzle portion of the tool against a workpiece.

Nozzle member 6 is provided with a longitudinal bore 142 which is adapted to slidably receive hammer 64 as the hammer reciprocates. Nozzle 6 is bevelled on one side 144 and has a bottom surface 146 which may but need not be provided with a flange 148. Preferably flange 148 forms a right angle with bottom surface 146 and assists aligning the nozzle with the edge of a carpet tacking strip 150 (see FIG. 2) which is to be fastened to a floor 152. Bottom surface 146 is set at a suitable angle off the vertical defined by hammer 64 and bore 142. By way of example, surface 146 may be set at any angle of between 5 and 15 degrees off the aforesaid vertical, depending upon the dimension of the tool, so as to assure clearance between the tool and a building wall 153 as hereinafter explained in greater detail.

Nozzle 6 is provided with a detachable magazine 154 which may be substantially the same as the magazine shown and described in U.S. Pat. No. 4,040,554. The magazine may be secured to the tool in various ways. Thus, for example, the magazine may be provided at its sides and bottom with a flange, part of which is shown at 151, and be secured to the nozzle by screws as shown at 155 which pass through flange 151 and screw into the nozzle. An opening 156 is provided in nozzle 6 and intersects bore 142 to allow the fasteners 157 held in magazine 154 to be positioned in bore 142 in front of retracted hammer 64. Fasteners 157 are supported in the magazine by a strip of plastic sleeves 159, in the manner of the clips described in my U.S. Pat. No. 4,106,618. Magazine 154 is provided with an extension 158 which is adapted to engage floor 152 when surface 146 of nozzle 6 is seated flat upon carpet tacking strip 150. Preferably the lower surface of extension 158 is flat and disposed at the same angle as surface 146, so that it will sit flush on the floor when a tacking operation is being accomplished.

Operation of the tool will now be described. First air under pressure, e.g. 150 psi, is supplied to port 78 by connecting the port to a suitable supply of pressurized air. The pressurized air enters port 78 and passes through passageway 80 to the valve port 90. Here the pressurized air forces valve head 98 away from port 90 so that port 90 is opened and port 96 closed off. Pressurized air passes into the interior of valve 86 and out port 92 into passageway 94, from which it proceeds to pressurize chamber 95. As chamber 95 pressurizes poppet valve 14 is forced to seat upon the top lip of cylinder 52 and thereby close off the top end of the cylinder. While this is occurring, air simultaneously enters passageway 82 from passageway 80 and proceeds to pressurize chamber 76. Pressurized air from chamber 76 enters valve 106 and forces valve head 124 to close off port 122. Pressurized air also enters cylinder 52 via port 118 and passageway 120 and forces piston 73 to rise to the top of the cylinder where it seats against the bottom pad 32 of poppet valve 14. It should be noted that the effective surface area of upper surface 48 is made greater than the surface area on the bottom of pad 32 so as to effectively insure that the poppet valve will come to rest on the top of cylinder 52 rather than settling into an equilibrium condition with the piston at some point above cylinder 52.

The pressurized tool is in an equilibrium state once poppet valve 14 engages piston 73 and seats upon the top of cylinder 52. An operator now grips the tool about handle 4 and places nozzle 6 against carpet tacking strip 150 in the manner shown in FIG. 2. In this position surface 146 of nozzle 6 sits flush on the top of strip 150 with flange 148 engaging one edge of the strip. As this is done rod 140 is forced upwards into nozzle 6 and through its associated linkage causes valve head 124 to close off port 116 and open port 122. This causes the pressurized air within cylinder 52 to bleed out into the atmosphere, thereby removing the force on the underside of the piston and priming the tool for firing. Now if the trigger 102 is depressed so valve head 98 moves to close off port 90, chamber 95 will be vented to the atmosphere in the manner previously described and the pressure in chamber 76 will force the poppet valve to move rapidly upwards towards surface 50 and the full pressure of chamber 76 will come to act on the upper end of piston 73 so as to drive it through its impact stroke and thereby cause hammer 64 to engage a fastener 157 advanced into bore 142 by magazine 154 and thereby drive it from nozzle 6 into strip 150 and floor 152. The piston 73 will not return to its raised position until rod 138 and trigger 102 are both released.

It should be noted that the recoil action of the tool will tend to be along the axis of hammer 64 which is tilted according to the angle of surface 146. Hence when the tool is positioned to secure a nailing strip next to a building wall, the tool will not tend to be driven up along the wall so as to cause damage by abrasion or impact. In this connection it should be noted that bevelling the nozzle on the side which faces the building wall allows the tool to be positioned so as to permit the tacking strip to be secured close to the wall as required in normal installations while still affording clearance between the tool and wall. Typically the tacking strips are secured about ¼ to ½" from a building wall. If necessary to assure ample clearance a portion of the housing also may be bevelled shown at 147 as a continuation of the bevelled surface 144 of the nozzle. Bevelled surfaces 144 and 147 are set at substantially a right angle to bottom surface 146. The purpose of this insertion is to provide a basis in the specification for the subject matter of claims 2 and 12 (see 37 C.F.R. 1.75(d)(1)).

Of course, the preferred embodiment illustrated and described herein is intended solely for the sake of example and clarity and is to be in no way construed as limiting the scope of the present invention, since various alterations may be carried out on the illustrated embodiment without departing from the essential features of the invention. Thus, for example, one might lengthen the bottom surface 146 to accommodate a workpiece of different width than that of a typical carpet tacking strip. Or one might conceivably close off ports 97 or 99 to facilitate formation of handle member 4. In this connection it should be noted that the grip portion 105 of handle 4 is made hollow to help reduce the weight of the tool and also facilitate installation of trigger 102. Also contemplated is substituting a different linkage to connect rod 138 with rod 136. One such possible linkage is that shown in U.S. Pat. No. 4,040,554. These and other changes of their type are foreseen as readily obvious to one skilled in the art, and hence are considered within the scope of the present invention.

There are many advantages to using the present tool. First, the tool utilizes pressurized air for its energy source, thereby assuring a tool which is fast, clean and relatively quiet in operation. Second, the tool provides the power necessary to set fasteners in concrete while remaining small in size and operating at pressures in the vicinity of 150 psi. This helps reduce operator fatigue while making the tool useful in a wider range of applications. Third, the tool is provided with a handle on its top and a foot on its magazine to assist in stabilizing the tool with one hand while holding a loose nail strip in desired nailing position with the other. Fourth, the nozzle is provided with a flange thereon to facilitate positioning the tool relative to the carpet tacking strip which is being fastened down, thereby assuring the correct position of the fastener in the tacking strip. Fifth, the nozzle is deliberately shaped to allow setting a fastener very close to a wall, e.g., $\frac{3}{4}$–$\frac{7}{8}$″ away, without having the tool touch the wall. This allows the tacking strips to be positioned close to walls where they are most effective without there being a need for the tool to contact easily damaged walls. And sixth, the tool is easily serviced. Nozzle 6 and handle 4 may be quickly detached from the main housing to facilitate cleaning or repair, while the two openings 97 and 99 in the handle section facilitate installation and removal of trigger 102 and control valve 86 without having to dismantle handle 4 from housing 2. The tool also may be employed for purposes other than fastening carpet tacking strips. Thus, for example, it may be used for anchoring metal channels to concrete ceilings or for fastening metal decking. Other uses also will be obvious to persons skilled in the art. Still another advantage is that the size of the tool may be varied, e.g. made larger for heavy duty exterior work, without materially altering its construction or changing its mode of alteration.

I claim:

1. A pneumatic tool comprising:

a hollow housing having oppositely disposed upper and lower ends;

upper end means closing off said upper end of said housing, said upper end means including a handle for use in holding said tool in working position, said handle being substantially aligned with the upper and lower ends of said housing;

a trigger;

a hollow cylinder mounted in said housing, said cylinder having upper and lower ends;

a piston slidably mounted in said cylinder;

a hammer connected to said piston;

lower end means for closing off said lower ends of said cylinder and said housing, said lower end means having a first bore therein for slidably receiving said hammer;

an air reservoir within said housing exterior of said cylinder;

an inlet for connecting said tool to a regulated source of high pressure air;

a passageway connecting said inlet to said reservoir;

a primer valve mounted to said housing for alternately (1) transmitting high pressure air from said air reservoir to said lower end of said cylinder below said piston, and (2) exhausting high pressure air from said lower end of said cylinder below said piston;

a rod movably carried by said lower end means for operating said primer valve;

a poppet valve within said housing for rapidly opening or closing said upper end of said cylinder above said piston, in order that high pressure air from said air reservoir may or may not be admitted to the upper end of said cylinder above said piston; and a control valve disposed in said upper end means above said poppet valve for operation by said trigger for alternately (1) transmitting high pressure air from said inlet to said poppet valve so as to cause said poppet valve to close off said end of said cylinder above said piston, or (2) exhausting said high pressure air from said poppet valve so as to cause said poppet valve to open up said upper end of said cylinder above said piston, in order that said piston may be driven from said upper end of said cylinder to said lower end of said cylinder when (a) said rod-operated primer valve has exhausted high pressure air from said lower end of said cylinder below said piston and (b) said control valve has exhausted said high pressure air from said poppet valve so as to cause said poppet valve to open up said upper end of said cylinder above said piston to the high pressure air of said air reservoir.

2. A pneumatic tool according to claim 1 wherein said hollow housing includes a front side, and said lower end means includes a front side aligned with said front side of said hollow housing and a first flat bottom surface for engaging the top of a workpiece, said first surface being disposed at an acute angle to the axis of said hammer, and further wherein said front side of said lower end means and an adjacent portion of said front side of said hollow housing are set at substantially a right angle to said first bottom surface of said lower end means.

3. A pneumatic tool according to claim 2 wherein said lower end means has a second end surface for engaging the side of said workpiece, said second end surface intersecting said first end surface at substantially a right angle.

4. A pneumatic tool according to claim 1 wherein said rod is slidably positioned in a bore in said lower end means.

5. A pneumatic tool according to claim 1 wherein said trigger is pivotally carried by said upper end means in position to be engaged by the hand of an operator gripping said handle.

6. A pneumatic tool according to claim 2 further including a magazine for containing a supply of fasteners, said magazine being mounted to said lower end means, and further wherein said lower end means has an opening therein for allowing fasteners to be advanced from said magazine into said first bore below said hammer when said piston is disposed at the upper end of said cylinder.

7. A pneumatic tool according to claim 6 wherein said magazine is adapted to engage the surface supporting said workpiece when said first flat bottom surface sits flush on a flat workpiece.

8. A pneumatic tool according to claim 1 wherein said control valve includes a valve head adapted to move in a direction substantially parallel to the movement of said piston.

9. A pneumatic tool comprising:

a hollow housing having a front side;

a cylinder within said housing and an air reservoir chamber formed by said housing around said cylinder, said cylinder and said housing each having corresponding first and second opposite ends;

a piston slidably mounted in the cylinder;

a hammer connected to the piston within the cylinder;

first end means closing off said first end of said cylinder and second end means closing off said first end of said housing, said first end and second end means having aligned openings through which said hammer slidably extend;

a poppet valve casing in said housing at its second end;

third end means closing off the second end of said housing, said third end means comprising (a) wall means forming at least a part of said poppet valve casing, (b) wall means defining a cavity for receiving a control valve casing having first, second and third ports, (c) a first passageway connected to said poppet valve casing, (d) wall means defining a vent valve casing with a vent hole leading to the atmosphere exterior of said tool, (e) an inlet for connecting said tool to a source of high pressure air, (f) a second passageway connected to said inlet, and (g) a third passageway connecting said inlet to said air reservoir chamber;

a poppet valve member slidably mounted within said poppet valve casing for opening and closing off the second end of said cylinder according to the differential between the air pressure within said poppet valve casing and the air pressure within said reservoir chamber;

a vent valve member in said vent valve casing connecting said same casing to the second end of said cylinder and adapted to close off said vent hole when said poppet valve member is in open position relative to said cylinder;

a control valve casing having first, second and third ports disposed in said cavity so that said first port leads to the atmosphere exterior of the tool, said second port is connected to said first passageway and said third port is connected to said second passageway;

a control valve member slidably disposed within said control valve casing and movable between a first limit position where it closes off said first port and a second limit position where it closes off said third port, said control valve member also being incapable of closing off said second port and being biased to said first limit position by high pressure air admitted to said third port via said second passageway, a handle on said third end means whereby to permit the tool to be held by an operator, said handle being substantially aligned with said first and second end means;

manually operable means attached to said handle for forcing said control valve member in a direction to close off said third port; and means including a primer valve at said first end of said housing for alternately (1) transmitting high pressure air from said reservoir chamber to said first end of said cylinder and (2) exhausting high pressure air from said first end of said cylinder, and a rod carried by said second end means for operating said primer valve when said rod is engaged with a work surface.

10. A pneumatic tool according to claim 9 wherein said second end means has a nozzle with said hammer and said rod slidably disposed in said nozzle, and further wherein said nozzle is adapted for attachment thereto of a magazine for holding fasteners to be driven by said hammer.

11. A pneumatic tool according to claim 10 wherein said nozzle has a flat end surface for engaging a workpiece and said rod normally projects beyond said surface when high pressure air is in said reservoir chamber, and further wherein said flat surface extends at an acute angle to the axis of said hammer.

12. A pneumatic tool according to claim 11 wherein said nozzle has a second end surface for engaging the side of said workpiece, said second end surface intersecting said flat end surface at a substantially right angle.

13. A pneumatic tool according to claim 12 wherein said front side of said second end means and an adjacent portion of said front side of said hollow housing are set at a substantially right angle to said flat end surface.

14. A pneumatic tool according to claim 9 wherein said handle is an integral part of said third end means.

15. A pneumatic tool of the type comprising:

a hollow housing having oppositely disposed upper and lower ends;

upper end means closing off said upper end of said housing;

a trigger carried by said upper end means;

a hollow cylinder mounted in said housing, said cylinder having upper and lower ends;

a piston slidably mounted in said cylinder;

a hammer connected to said piston;

lower end means for closing off said lower ends of said cylinder and said housing, said lower end means having a first bore therein for slidably receiving said hammer;

an air reservoir within said housing exterior of said cylinder;

an inlet for connecting said tool to a regulated source of high pressure air;

a passageway connecting said inlet to said reservoir;

a primer valve mounted to said housing for alternately (1) transmitting high pressure air from said air reservoir to said lower end of said cylinder below said piston, and (2) exhausting high pressure air from said lower end of said cylinder below said piston;

a rod movably carried by said lower end means for operating said primer valve; and a poppet valve within said housing for rapidly opening or closing said upper end of said cylinder above said piston, in order that high pressure air from said air reservoir may or may not be admitted to the upper end of said cylinder above said piston;

characterized by said upper end means including (1) said inlet for connecting said tool to a regulated source of high pressure air, (2) at least part of said passageway connecting said inlet to said reservoir, (3) a handle for holding said tool in a working position, said handle being substantially aligned with said upper and lower ends of said housing, (4) a trigger operable while gripping said handle, and (5) a control valve disposed for operation by said trigger for alternately (a) transmitting high pressure air from said inlet to said poppet valve so as to cause said poppet valve to close off said end of said cylinder above said piston, or (b) exhausting said high pressure air from said poppet valve so as to cause said poppet valve to open up said upper end of said cylinder above said piston, in order that said piston may be driven from said upper end of said cylinder to said lower end of said cylinder when (1) said rod-operated primer valve has exhausted high pressure air from said lower end of said cylinder below said piston and (2) said control valve has exhausted said high pressure air from said poppet valve so as to cause said poppet valve to open up said upper end of said cylinder above said piston to the high pressure air of said air reservoir.

16. In a pneumatic tool comprising:

(1) a hollow housing having oppositely disposed upper and lower ends;

(2) a hollow cylinder mounted in said housing and having oppositely disposed upper and lower ends;

(3) a piston slidably mounted in said cylinder;

(4) a hammer connected to said piston;

(5) lower end means for closing off said lower ends of said cylinder and said housing, said lower end means having a first bore therein for slidably receiving said hammer;

(6) means for venting air from said lower end of said cylinder;

(7) an air reservoir contained within said housing, exterior of said cylinder;

(8) a poppet valve within said housing for rapidly opening or closing said upper end of said cylinder above said piston so as to control the inflow of air from said air reservoir to said cylinder above said piston; and (9) top end means for closing off said top end of said cylinder;

an improvement wherein said top end means comprises (a) a handle for use in holding said tool in working position, said handle being substantially aligned with said upper and lower ends of said housing, (b) a trigger pivotally mounted to said handle, (c) an inlet for connecting said tool to a regulated source of high pressure air, (d) a passageway for connecting said inlet to said air reservoir, and (e) a control valve disposed above said poppet valve and having a valve head adapted to reciprocate in substantially the same direction as said piston, said control valve being adapted to be actuated by said trigger so as to alternately (1) transmit high pressure air from said inlet to said poppet valve so as to cause said poppet valve to close off said upper end of said cylinder above said piston, or (2) exhaust said high pressure air from said poppet valve so as to cause said poppet valve to open up said upper end of said cylinder above said piston, in order that said piston may be driven from said upper end of said cylinder to said lower end of said cylinder when said control valve has exhausted said high pressure air from said poppet valve so as to cause said poppet valve to open up said upper end of said cylinder above said piston to the high pressure air of said air reservoir.

* * * * *